US009050830B2

(12) United States Patent
Grant et al.

(10) Patent No.: US 9,050,830 B2
(45) Date of Patent: Jun. 9, 2015

(54) INK JET PRINTER AND AN INK JET PRINTING PROCESS

(71) Applicant: Sun Chemical, B.V., Weesp (NL)

(72) Inventors: Alexander Grant, Bath (GB); Samuel Thomas Moncur, North Somerset (GB); Andrew Robin Balch, Bath (GB); Nigel Anthony Caiger, Somerset (GB); Hartley David Selman, Bristol (GB)

(73) Assignee: Sun Chemical Corporation, Parsippany, NJ (US)

( * ) Notice: Subject to any disclaimer, the term of this patent is extended or adjusted under 35 U.S.C. 154(b) by 193 days.

(21) Appl. No.: 13/865,809

(22) Filed: Apr. 18, 2013

(65) Prior Publication Data

US 2013/0235140 A1 Sep. 12, 2013

Related U.S. Application Data

(62) Division of application No. 12/813,858, filed as application No. PCT/GB2009/000015 on Jan. 5, 2009, now Pat. No. 8,449,076.

(30) Foreign Application Priority Data

Jan. 16, 2008 (GB) ..... 0800793.2

(51) Int. Cl.

| | |
|---|---|
| ***B41J 2/04*** | (2006.01) |
| ***B41J 2/01*** | (2006.01) |
| ***B41J 11/00*** | (2006.01) |
| ***B41J 2/045*** | (2006.01) |
| ***B41J 2/165*** | (2006.01) |
| ***B41J 15/04*** | (2006.01) |

(52) U.S. Cl.
CPC ..... *B41J 11/0015* (2013.01); *B41J 2/04566* (2013.01); *B41J 2/16552* (2013.01); *B41J 15/04* (2013.01)

(58) Field of Classification Search
CPC . B41J 2/04566; B41J 13/0081; B41J 13/0009
See application file for complete search history.

(56) References Cited

U.S. PATENT DOCUMENTS

| | | | | |
|---|---|---|---|---|
| 7,086,727 | B2 * | 8/2006 | Nishikawa et al. | 347/102 |
| 2004/0060466 | A1 | 4/2004 | Nozawa et al. | |
| 2006/0284928 | A1 * | 12/2006 | Park | 347/42 |

FOREIGN PATENT DOCUMENTS

| | | | | |
|---|---|---|---|---|
| JP | 62440 | H2 | 5/1990 | |
| JP | 507651 | H6 | 5/1990 | |
| JP | 072900 | | 3/1999 | |
| JP | 2000-255053 | * | 9/2000 | B41J 2/01 |
| JP | 2003-165203 | | 6/2003 | |
| JP | 2005-288913 | | 10/2005 | |
| WO | WO 92/14794 | A1 | 9/1992 | |

* cited by examiner

*Primary Examiner* — Geoffrey Mruk
(74) *Attorney, Agent, or Firm* — Charles C. Achkar; Ostrolenk Faber LLC

(57) ABSTRACT

The invention provides a drop-on-demand ink jet printing apparatus for printing inks comprising water or a volatile solvent onto a continuous web substrate, the printing apparatus comprising: a print head, a chamber for retaining water or solvent vapor in the vicinity of the print head, the chamber having an inlet for the continuous web substrate and an outlet for the printed continuous web substrate, and means for feeding the continuous web substrate through the chamber inlet into the chamber, past the print head and out of the chamber outlet.

20 Claims, 2 Drawing Sheets

INK JET PRINTER AND AN INK JET PRINTING PROCESS

Figure 1:
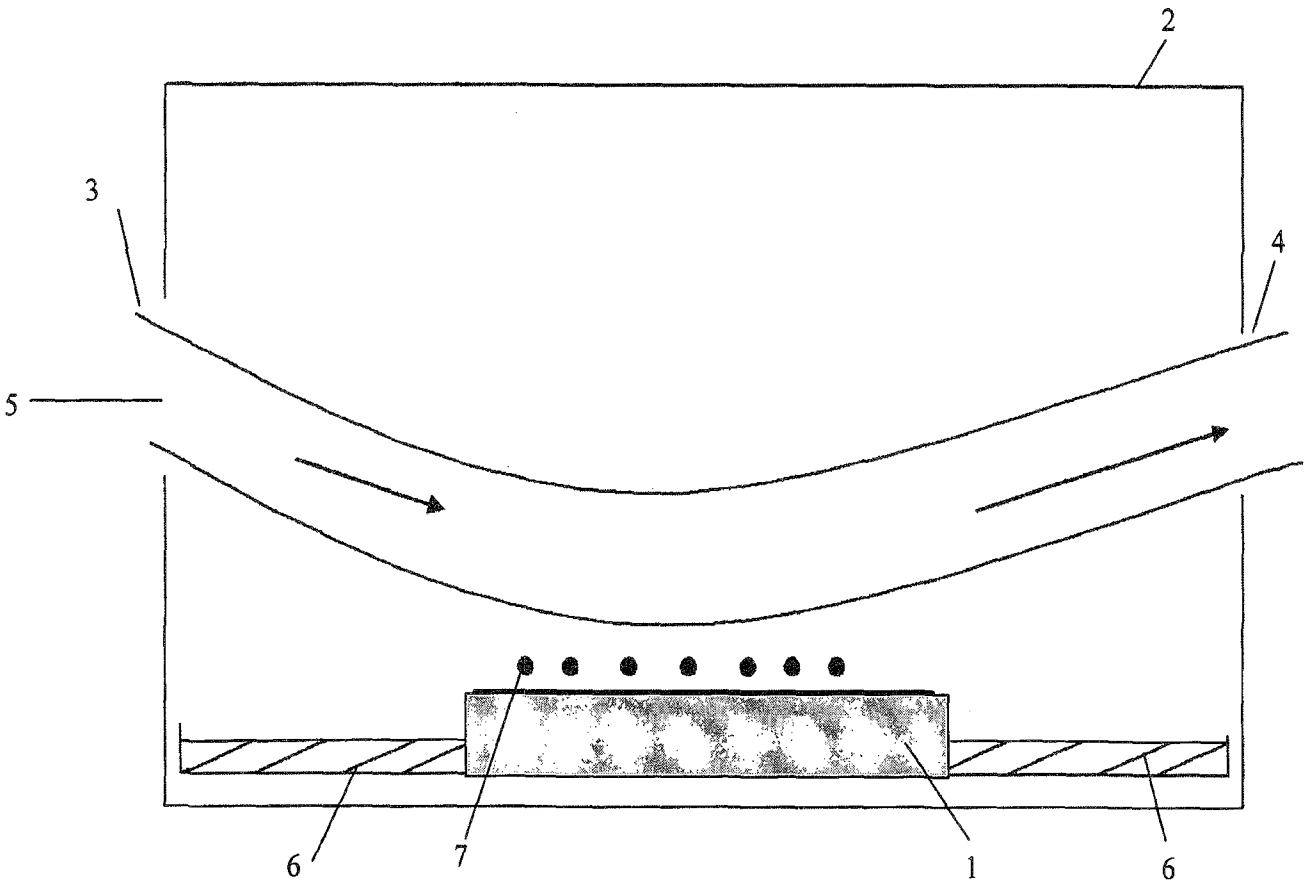

This application is a divisional of allowed U.S. patent application Ser. No. 12/812,858, filed Jul. 14, 2012, which is the National Stage of Int. App. Ser. No. PCT/GB2009/000015, filed Jan. 5, 2009, which claims benefit of priority under 35 U.S.C. §119(e) to United Kingdom Pat. App. Ser. No. 0800793.2, filed Jan. 16, 2008. The disclosure of each of the above-referenced applications is incorporated herein by reference in its entirety.

The invention relates to an ink jet printer and to an ink jet printing process. In particular, but not exclusively, the invention is directed to an ink jet printer adapted to be suitable for use with ink jet inks containing volatile components such as water and/or organic solvents, and to a process of printing with the printer.

The printing of packaging materials for food and other goods has traditionally been done using traditional printing methods such as flexographic printing. Typically the inks used in the flexographic printing of packaging materials are based on volatile organic solvents such as ethanol and ethyl acetate. The inks therefore dry very quickly which allows the print line to be run at a relatively high speed.

Ink jet printing has a number of advantages over traditional printing methods including short set up times and the ability to print from an image stored in a computer without the need for preparing artwork or other printing elements. However, in drop-on-demand ink jet printing the use of fast drying solvent based inks can cause nozzle blockage, which necessitates regular print head maintenance and can cause irreversible damage to the print head. For that reason, solvent based inks for industrial drop-on-demand ink jet printing are designed to dry more slowly and therefore a heating step is really needed after the printing in order to dry the ink in a reasonable time. Water and solvent free radiation curable ink jet inks are known and can be dried very quickly using, for example, UV radiation. However, those inks have not found much application in packaging, especially packaging for food materials, because of the potential for uncured monomer to migrate from the printed packaging material.

Fast drying inks have been used in continuous ink jet printing because in continuous ink jet printing the print nozzles are in constant use and therefore blockage caused by drying of the ink in the nozzle is unlikely to occur. However, continuous ink jet printing is typically used for printing applications such as batch and date codes where high resolution is not required and is not suitable for producing high quality images generally required in packaging.

There therefore remains a need for an ink jet printer and a process of ink jet printing that can use solvent based ink jet inks that dry rapidly on the printed media but which does not suffer from the problems of nozzle blockage caused by drying of the inks in the print head nozzles.

Water based ink jet inks for use in the home, office and other applications are well known. Water is relatively volatile and evaporates at a rate which would lead to undesirable levels of nozzle blockage if it were not reduced by the presence in those inks of humectants such as glycerol, diethylene glycol and other glycols. Those humectants, which are often present at levels of up to 30 wt %, prevent the ink in the nozzles from drying out fully. However, they also prevent the inks from drying properly on non-porous substrates such as polymer films and for that reason, and others, it would be desirable to provide a process of printing in which water based inks having reduced levels of or no humectants can be used without unacceptable nozzle blockage occurring.

In mitigation of those needs, the present invention provides a drop-on-demand printing apparatus for printing inks comprising water or volatile solvents onto a continuous web substrate, the printing apparatus having a print head, a chamber for retaining water or solvent vapour in the vicinity of the print head, the chamber having an inlet for the continuous web substrate and an outlet for the printed continuous web substrate, and means for feeding the continuous web substrate through the chamber inlet into the chamber, past the print head and out of the chamber outlet.

The invention also provides a process of drop-on-demand ink jet printing which includes the steps of passing a continuous web substrate through an inlet into a chamber containing a print head, ink jet printing an ink jet ink onto the substrate, and passing the printed substrate through an outlet out of the chamber.

The chamber retains water or solvent vapour in the vicinity of the print head and in particular maintains water or solvent vapour in the vicinity of the print head nozzles and therefore helps to prevent evaporation of water or solvent from the inks in the print head nozzles thereby reducing the rate of ink drying and nozzle blockage. The atmosphere inside the chamber may be 90% saturated with the water or solvent vapour, and is preferably saturated with the water or solvent vapour. The chamber can be any suitable shape and configuration. Preferably, the inlet, the print head and the outlet are aligned such that the continuous web substrate can be fed into, through and out of the chamber easily. The means for feeding the continuous web substrate through the chamber inlet past the print head and out of the chamber inlet may be any suitable arrangement, for example, including conveyor belts, drive rollers, nip rollers and the like.

In drop-on-demand ink jet printing (as opposed to continuous ink jet printing) it is desirable for the gap between the print head nozzle and the substrate to be very small so that the distance travelled by the ink droplets is correspondingly also very small, in order to minimise the loss of resolution caused by deviation of the ink droplets as they travel towards the substrate. That is especially the case when printing high quality images such as those typically required on packaging materials. In the apparatus and process of the invention the substrate is carried into the chamber and therefore can be very close to the print head at the point of printing. Preferably, the arrangement of the printer is such that during printing the distance between the continuous web substrate and the print head is less than 1 mm, more preferably less than 0.75 mm and especially preferably 0.5 mm or less.

In one embodiment, the water or solvent vapour in the vicinity of the print head is generated by evaporation of water or solvent from the ink during printing. Optionally, the printing apparatus is also provided with further means for generating water or solvent vapour or introducing water or solvent vapour into the chamber, especially the vapour of the same volatile component or component mixture which is present in the ink. For example, the printing apparatus may be provided with a reservoir of water or solvent within the chamber such that water or solvent vapour is generated by evaporation from the water or solvent in the reservoir. The solvent or solvent mixture in the reservoir will typically be the same solvent or solvent mixture which is present in the ink. The reservoir may be provided with heating means for warming the solvent in the reservoir to promote evaporation of that solvent. The printing means is optionally provided with means for generating water or solvent vapour and then introducing water or solvent vapour into the enclosing chamber. For example, water or solvent vapour may be generated by warming or spraying water or solvent in a vapour production chamber and then transferred into the chamber surrounding the print head nozzles via one or more conduits. The water or solvent vapour is optionally passed into the chamber using a pump or fan.

The inlet and the outlet of the chamber may be of any suitable shape and configuration. Preferably, they will be so shaped as to minimise the distance between the periphery of the inlet or outlet and the substrate, in order to reduce losses of vapour from the chamber. The inlet may be a slot. Preferably, the inlet for the substrate is provided with a pair of nip rollers. The rollers may be driven or alternatively they may be idler rollers. Preferably, the outlet for the substrate is arranged so that the printed side of the substrate does not contact the periphery of the slot as it leaves the chamber in order to avoid smudging the wet ink. In one embodiment, the outlet for the substrate is a slot through which the substrate passes.

The ink jet ink comprises at least one volatile component such as water or an organic solvent. Optionally, the ink is such that it will dry rapidly by evaporation when printed onto a continuous web substrate at ambient temperatures under typical printing conditions. For example, the ink may be such that when ink jet printed onto a continuous web substrate it dries in less than 2 minutes, preferably less than 60 seconds, optionally less than 30 seconds at ambient temperature, that is, without being heated. In one embodiment the ink jet ink comprises one or more organic solvents. Optionally, the ink comprises at least 50 wt %, optionally at least 70 wt % and in some cases at least 80 wt % of a volatile organic solvent or a mixture of solvents having a boiling point of less than 140° C. In one embodiment the ink jet ink comprises at least 50 wt %, optionally at least 70 wt % and in some cases at least 80 wt % of a volatile organic solvent or a mixture of solvents having a boiling point of less than 110° C. In one embodiment the ink jet ink comprises at least 50 wt %, optionally at least 70 wt % and in some cases at least 80 wt % of a volatile organic solvent or a mixture of solvents having a boiling point of less than 90° C.

In one embodiment the ink jet ink comprises at least 50 wt %, optionally at least 70 wt % and in some cases at least 80 wt % of a volatile organic solvent or a mixture of such solvents having an evaporation rate of at least 1.0 (as measured relative to n-butyl acetate having an evaporation rate of 1.8). In one embodiment the ink jet ink comprises at least 50 wt %, optionally at least 70 wt % and in some cases at least 80 wt % of a volatile organic solvent or a mixture of such solvents having an evaporation rate of at least 0.5.

Boiling points and evaporation rates for a number of solvents commonly used in the printing industry are listed in the table below.

| | Boiling point ° C. | Evaporation rate* | Typical printing application | Comment |
|---|---|---|---|---|
| Isopropyl alcohol | 82.4 | 1.7 | Flexo/Gravure | Very fast drying |
| n-propyl acetate | 101 | 2.3 | Flexo/Gravure | |
| Isopropyl acetate | 85 | 3.5 | Flexo/Gravure | |
| Acetone | 56 | 6.06 | Flexo/Gravure | |
| Ethyl acetate | 77 | 4.94 | Flexo/Gravure | |
| Ethanol | 78 | 1.7 | Flexo/Gravure | |
| Cyclohexanone | 155 | 0.3 | Ink-jet - DOD | Slow drying |
| Ethyleneglycol butylether acetate | 192 | 0.03 | Ink-jet - DOD | |
| Diethyleneglycol ethyl ether acetate | 218 | 0.008 | Ink-jet - DOD | |
| Diisobutyl ketone | 170 | 0.176 | Ink-jet - DOD | |
| Hexyl acetate | 162 | 0.208 | Ink-jet - DOD | |
| Methylethyl ketone | 80 | 4.03 | Ink-jet - CIJ | Very fast drying |

-continued

| | Boiling point ° C. | Evaporation rate* | Typical printing application | Comment |
|---|---|---|---|---|

*rate relative to N-butylacetate = 1.80

Evaporation Rates and Boiling Rates of Common Ink Solvents

Preferably, the ink jet ink comprises one or more solvents selected from the group consisting isopropyl alcohol, n-propyl acetate, isopropyl acetate, acetone, ethyl acetate, ethanol, methyl ethyl ketone and mixtures thereof. Optionally, the ink comprises at least 50 wt %, preferably at least 70 wt % and in some cases at least 80 wt % of one or more solvents selected from the group consisting of isopropyl alcohol, n-propyl acetate, isopropyl acetate, acetone, ethyl acetate, ethanol, methyl ethyl ketone and mixtures thereof. Optionally, the ink is substantially free of water, for example, containing less that 1 wt % water.

In another embodiment, the ink is a water based ink comprising, for example, at least 40 wt %, optionally at least 50 wt % of water. Preferably, the ink comprises no more than 10 wt % of humectant, more preferably no more than 5 wt % of humectant. Especially preferably, the ink is substantially free, for example, comprising less than 1 wt % of humectant. The water based ink is optionally a radiation curable ink, for example, a uv curable ink. Water has an evaporation rate of only 0.36 (as measured relative to N-butyl acetate having an evaporation rate of 1.8) but is nonetheless considered to be a volatile component for the purposes of the present invention.

The continuous web substrate may be any continuous web substrate upon which it is desired to print an image. For example, the continuous web substrate may be paper. Alternatively, the continuous web substrate may be a polymeric film material. The continuous web substrate may be stored in the printing apparatus in the form of a roll. Optionally, the printing apparatus includes a store of the continuous web substrate, for example, a roll of the continuous web substrate. Optionally, the printing apparatus includes, downstream of the print head and chamber, a means for cutting the continuous web substrate into sections. Optionally, the printing apparatus includes a reservoir of the ink jet ink.

Optionally, the process of the invention includes the step of taking the continuous web substrate from a store of that substrate and passing it through the inlet into the chamber, ink jet printing on the substrate and then passing it through the outlet out of the chamber.

Optionally, the process further includes the step of subsequently cutting the printed substrate into sections. Preferably, the ink is allowed to dry before the cutting takes place.

Optionally, in the process of the invention the ink dries within 2 minutes, preferably within 60 seconds, more preferably within 10 seconds of leaving the outlet of the chamber. Optionally, the process involves the use of a dryer to dry the inks. For example, the dryer may be a forced air dryer. Optionally, the dryer is a hot air dryer and/or a radiant heat dryer.

The substrate may be a paper substrate. The substrate may be a polymeric film. The substrate may a substrate for use as a food wrapper.

Figure 2:
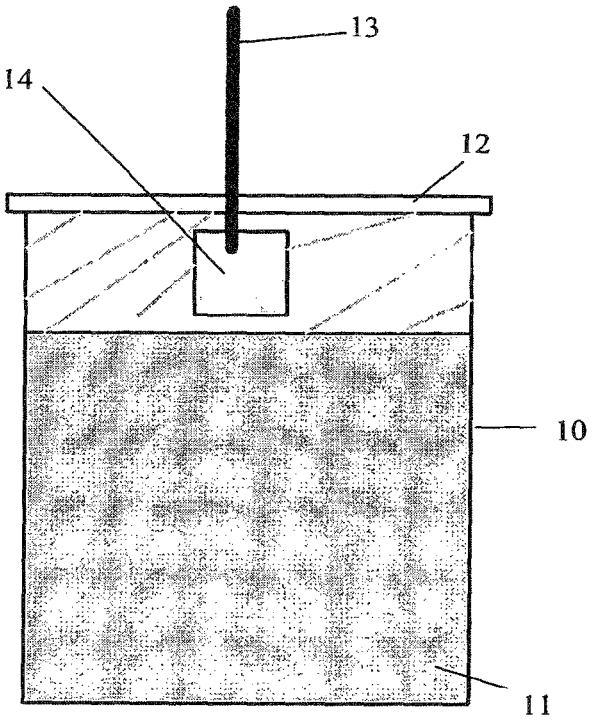

Embodiments of the invention will now be described for the purposes of illustration only and with reference to the following figures in which:

FIG. 1 is a schematic depiction of a print head enclosed in a chamber according to the invention, and FIG. 2 depicts schematically an apparatus used in testing the inventive concept.

FIG. 1 depicts schematically a part of a printing apparatus according to the invention. The printing apparatus comprises a print head 1 which is enclosed in a chamber 2. The chamber is provided with an inlet 3 and an outlet 4 and as shown in FIG. 1 a continuous web substrate 5 passes through the inlet 3 into the chamber and into close proximity with the print head 1 and then out of the outlet 4. Also enclosed in the chamber 2 are reservoirs 6 which contain the same solvent mixture as is present in the ink. The solvent evaporates from the reservoirs 6 and substantially saturates the atmosphere within the chamber 2 such that the evaporation of solvent from ink in the nozzles is inhibited. During printing, droplets of ink 7 are fired from the print head onto the substrate thereby forming an image on the substrate. The substrate is then transported out of the chamber through the outlet 4 and into the external atmosphere in which the ink dries.

To test the inventive concept on a small laboratory scale the simplified apparatus shown in FIG. 2 was set up as follows:

1. A 200 $cm^3$ tin 10 was filled ¾ full with a fast drying solvent 11.
2. The tin 10 was sealed with the lid 12 and left for approximately 60 minutes such that the atmosphere inside the tin became saturated with the solvent.
3. A hole was punched into a separate tin lid 12, through the hole a piece of string 13 was inserted, attached to which was a section of substrate 14 upon which a layer of fast drying solvent based ink had been drawn down.
4. The first tin lid was quickly replaced with the lid 12 having the substrate 14 attached such that the substrate 14 was suspended in the tin above the surface of the solvent 11 and a stopwatch was started.
5. After a predetermined period, the lid 12 and substrate 14 were removed and it was noted whether the ink had dried. If the ink had not dried, the time taken for the ink to dry in ambient conditions was noted.

A test was conducted using an ink containing a cyan dye, a maleic resin and 84 wt % of isopropyl alcohol. The solvent 11 placed in the tin was isopropyl alcohol. The time taken for the draw down to dry in air without being placed in the tin was 20 seconds. When placed in the tin the draw down had not dried even after 60 seconds. Once removed from the tin the draw down dried in approximately 2 seconds. The surprising reduction in drying time following removal of the draw down from the tin as compared to the time taken for the control experiment to dry naturally is assumed to be due to the loss of some solvent in the tin but not enough to cause drying.

The test was repeated using a methoxy propanol based ink and with methoxy propanol as the solvent 12 inside the tin. The time taken for the draw down to dry naturally in air as a control experiment was found to be 90 seconds. When placed in the tin in accordance with the above procedure the draw down had not dried even after 150 seconds. Following removal from the tin the draw down dried in approximately 2 seconds.

As a further test of the inventive concept a drop-on-demand print head (a Dimatix Nova 256 Jet) was loaded with a cyclohexanone based ink. Printing was then started and the number of nozzles firing was noted. Printing was then stopped and the print head was left for a set amount of time. The printing was then briefly recommenced and again the number of nozzles firing was noted. The procedure was then repeated using different time intervals. The whole process was then carried out again but this time the print head was enclosed in a metal chamber containing a solvent reservoir during the times when the print head was not printing. When it was decided to print, the chamber was quickly removed, printing was undertaken, the number of nozzles was noted, printed was ceased and the chamber was replaced around the print head.

For the experiment carried out with the print head continuously exposed to the atmosphere a bank of 10 jets was studied. After 5 minutes without printing one nozzle (10%) was blocked, after 11 minutes without printing four nozzles (40%) had become blocked and after 33 minutes without printing, seven nozzles (70%) had become blocked. This demonstrates that nozzles quickly block to an unacceptable level when a solvent based ink is used in a drop-on-demand ink jet printer even when the solvent, cyclohexanone, is not an especially volatile one. It would be expected that for inks based on a volatile solvent of the type used in fast drying flexographic inks, the nozzle blockage would occur even more quickly.

In the repeat experiment in which the print head was enclosed in a solvent containing chamber during non-printing intervals, tests at 11 and 30 minutes without printing showed that no nozzles were blocked and after 210 minutes without printing, only one nozzle (10%) had become blocked. This shows that enclosing the print head in a chamber containing a solvent saturated atmosphere very significantly reduces the rate of nozzle blockage.

The skilled person will be aware of many variations which can be made within the scope of the invention. For that reason, in determining scope of the invention regard should be had to the appended claims.

We claim:

1. A method of drop-on-demand ink jet printing comprising:

feeding a continuous web substrate through an inlet into a chamber containing a print head, wherein the chamber retains water vapour or solvent vapour in the vicinity of the print head;

ink jet printing an ink jet ink onto the substrate; and feeding the printed substrate through an outlet out of the chamber, wherein the chamber further comprises a reservoir that contains either liquid water or solvent, that has a liquid surface exposed to an interior of the chamber.

2. The method of claim 1, wherein each of the inlet and outlet is in the shape of a slot.

3. The method of claim 1, wherein the reservoir further comprises a heating means for warming either the liquid water or solvent contained in the reservoir.

4. The method of claim 1, wherein the continuous web substrate is fed through the chamber inlet into the chamber, past the print head and out of the chamber outlet by a feeding mechanism.

5. The method of claim 4, wherein the feeding mechanism comprises one or more conveyor belts, drive rollers or nip rollers.

6. The method of claim 1, wherein the continuous web substrate is disposed no more than 1 mm from the print head during printing.

7. The method of claim 1, wherein the chamber further comprises a source of an ink jet ink comprising at least 50% by weight of a volatile organic solvent having a boiling point no higher than 140[deg.] C.

8. The method of claim 1, wherein the chamber further comprises a source of a water-based ink jet ink.

9. The method of claim 1, wherein the chamber has an atmosphere surrounding the print head and continuous web substrate that is at least 90% saturated with water vapour or solvent vapour.

10. The method of claim 1, wherein the ink jet ink comprises at least 50 wt % of a volatile organic solvent having an evaporation rate of at least 1.0 as measured relative to the evaporation rate of n-butyl acetate.

11. The method of claim 1, wherein the ink jet ink comprises at least 50 wt % of one or more solvents selected from among isopropyl alcohol, n-propyl acetate, isopropyl acetate, acetone, ethyl acetate, ethanol and methyl ethyl ketone.

12. The method of claim 1, wherein the distance between the print head and the substrate is no more than 1 mm.

13. The method of claim 1, wherein the substrate is suitable for use as a food wrapper.

14. The method of claim 1, wherein the ink jet ink comprises at least 50 wt % of a volatile organic solvent having an evaporation rate of at least 1.0 as measured relative to the evaporation rate of n-butyl acetate and the distance between the print head and the substrate is no more than 1 mm.

15. The method of claim 14, wherein the volatile organic solvent is selected from among isopropyl alcohol, n-propyl acetate, isopropyl acetate, acetone, ethyl acetate, ethanol and methyl ethyl ketone.

16. A method of drop-on demand ink jet printing comprising:

feeding a continuous web substrate through an inlet into a chamber containing a print head that retains water vapour or solvent vapour in the vicinity of the print head, wherein the chamber comprises a reservoir for generating or introducing water vapour or solvent vapour into the chamber;

ink jet printing an ink jet ink onto the substrate; and feeding the printed substrate through an outlet out of the chamber; wherein:

the continuous web substrate is fed through the chamber inlet into the chamber, past the print head and out of the chamber outlet by a feeding mechanism; and wherein the chamber has an atmosphere surrounding the print head and continuous web substrate that is at least 90% saturated with either water vapour or solvent vapour.

17. The method of claim 16, wherein the continuous web substrate is disposed no more than 1 mm from the print head during printing.

18. A printing process comprising applying an ink jet ink onto a continuous web substrate, feeding the substrate through a chamber inlet into the chamber that contains the print head, past the print head and out of the chamber outlet by a feeding mechanism; wherein the chamber, that comprises a reservoir for either generating or introducing vapour either water or solvent into the chamber, retains water vapour or solvent vapour in the vicinity of the print head; and, wherein the continuous web substrate is disposed no more than 1 mm from the print head during printing; and wherein the chamber has an atmosphere surrounding the print head and continuous web substrate that is at least 90% saturated with either water vapour or solvent vapour.

19. The process of claim 18, wherein the chamber further comprises a source of a water-based ink jet ink.

20. The process of claim 18, wherein the process is a drop-on demand ink jet printing process.

* * * * *